US012669032B2

(12) United States Patent
Chen

(10) Patent No.: US 12,669,032 B2
(45) Date of Patent: Jun. 30, 2026

(54) DOWNHOLE INFLOW CONTROL VALVE WITH MULTI-STAGE REGULATION

(71) Applicant: CONOVA LLC, Beijing (CN)

(72) Inventor: Yanhong Chen, Beijing (CN)

(73) Assignee: Conova LLC, Austin, TX (US)

( * ) Notice: Subject to any disclaimer, the term of this patent is extended or adjusted under 35 U.S.C. 154(b) by 0 days.

(21) Appl. No.: 19/030,970

(22) Filed: Jan. 17, 2025

(65) Prior Publication Data

US 2025/0382855 A1 Dec. 18, 2025

(30) Foreign Application Priority Data

Jun. 18, 2024 (CN) ..... 202410787420.2

(51) Int. Cl.
*E21B 34/14* (2006.01)
*E21B 43/08* (2006.01)

(52) U.S. Cl.
CPC ..... *E21B 34/14* (2013.01); *E21B 43/08* (2013.01); *E21B 2200/06* (2020.05)

(58) Field of Classification Search
CPC ..... E21B 34/14; E21B 43/08; E21B 2200/06
See application file for complete search history.

(56) References Cited

U.S. PATENT DOCUMENTS 4,691,778 A * 9/1987 Pyne ..... E21B 34/10 137/538
7,234,518 B2 * 6/2007 Smith ..... E21B 43/12 166/227
8,210,258 B2 * 7/2012 O'Malley ..... E21B 47/10 166/250.15

FOREIGN PATENT DOCUMENTS

CA 2858643 A1 * 6/2013 ..... E21B 34/14
CN 201915903 U 8/2011
CN 114526033 A 5/2022

OTHER PUBLICATIONS

First Office Action received in Chinese Application No. 202410787420.2, dated Dec. 19, 2024.

* cited by examiner

*Primary Examiner* — D. Andrews
(74) *Attorney, Agent, or Firm* — CM Law LLP; Robert C. Klinger

(57) ABSTRACT

A downhole inflow control valve with multi-stage regulation is provided. The downhole inflow control valve with multi-stage regulation includes a sand control screen, a sliding sleeve, an oil nozzle sleeve and a driver. The driver is configured for driving the sliding sleeve to reciprocate. The sliding sleeve is located between the sand control screen and the oil nozzle sleeve. Screen holes are formed in the sand control screen. One of the oil nozzle sleeve and the sliding sleeve is provided with oil inlet nozzle groups, and the other of the oil nozzle sleeve and the sliding sleeve is provided with oil inlet holes. The sliding sleeve and the oil nozzle sleeve are connected through a cam mechanism. One of the sliding sleeve and the oil nozzle sleeve is fixed, an other of the sliding sleeve and the oil nozzle sleeve may rotate around own axis.

4 Claims, 6 Drawing Sheets

DOWNHOLE INFLOW CONTROL VALVE WITH MULTI-STAGE REGULATION

CROSS-REFERENCE TO RELATED APPLICATION

This patent application claims the benefit and priority of Chinese Patent Application No. 202410787420.2 filed with the China National Intellectual Property Administration on Jun. 18, 2024, the disclosure of which is incorporated by reference herein in its entirety as part of the present application.

TECHNICAL FIELD

The present disclosure relates to the field of screen pipe completion, and specifically relates to a downhole inflow control valve with multi-stage regulation.

BACKGROUND

Screen pipe completion technology refers to the technology that a screen pipe is installed in the well hole so that oil and gas enter the well naturally with underground pressure while sand is prevented from entering the well. In order to realize the refined control of the oil well production process and ultimately improve the oil well yield, it is necessary to monitor and control the oil layer production performance in real time according to the actual production situation of the oil well.

For this reason, it is necessary to control the inflow rate of oil and gas passing through the screen pipe into the well.

SUMMARY

The present disclosure aims to provide a downhole inflow control valve with multi-stage regulation so as to solve the technical problem that the inflow rate in the screen pipe completion process is controlled.

In order to solve the technical problem, the present disclosure provides the following technical solutions.

A downhole inflow control valve with multi-stage regulation, including: an outer layer structure including a sand control screen; a middle layer structure including a sliding sleeve; an inner layer structure including an oil nozzle sleeve; and a driver configured for driving the sliding sleeve to reciprocate along an axis of the sliding sleeve, where, the sliding sleeve is located between the sand control screen and the oil nozzle sleeve, screen holes are formed in the sand control screen, oil inlet nozzle groups are uniformly arranged on one of the oil nozzle sleeve and the sliding sleeve around an axis of the oil nozzle sleeve or the axis of the sliding sleeve, oil inlet holes capable of interfacing with any one of the oil inlet nozzle groups are formed on an other of the oil nozzle sleeve and the sliding sleeve, and oil on an outer side of the sand control screen enters into an inner side of the oil nozzle sleeve through the screen holes, the oil inlet nozzle groups and the oil inlet holes to realize inflow; the sliding sleeve and the oil nozzle sleeve are connected through a cam mechanism, one of the sliding sleeve and the oil nozzle sleeve is fixed, an other of the sliding sleeve and the oil nozzle sleeve is capable of rotating around the axis of the other of the sliding sleeve and the oil nozzle sleeve, inflow rates of the oil inlet nozzle groups are different, the cam mechanism is configured for converting a linear motion of the sliding sleeve into a rotary motion of the sliding sleeve or the oil nozzle sleeve to promote the oil inlet holes to interface with different oil inlet nozzle groups so as to control the inflow rates.

Further, each of the oil inlet nozzle groups includes first oil nozzles equally spaced around a circumference of the oil nozzle sleeve, and openings of the first oil nozzles are gradually increased or gradually decreased along a clockwise direction; the cam mechanism includes: first cam slots and second cam slots which are continuously formed on the oil nozzle sleeve along the circumference of the oil nozzle sleeve, where projections of the first cam slots and the second cam slots on a cross section of the oil nozzle sleeve are in shapes of annular sectors, widths at ends, away from the second cam slots, of the first cam slots are gradually decreased to form first internal corner ends, widths at ends, away from the first cam slots, of the second cam slots are gradually decreased to form second internal corner ends, first external corner ends toward centers of the second cam slots are formed between adjacent first cam slots of the first cam slots, and second external corner ends toward centers of the first cam slots are formed between adjacent second cam slots of the second cam slots; and a cam follower fixedly connected to the sliding sleeve and slidably connected to the first cam slots or the second cam slots, where the cam follower rotates around the circumference of the oil nozzle sleeve in processes of moving from the first internal corner ends to the second internal corner ends or moving from the second internal corner ends to the first internal corner ends to enable the oil inlet holes to sequentially align to different first oil nozzles.

In another embodiment, each of the oil inlet nozzle groups includes first oil nozzles and second oil nozzles equally spaced around a circumference of the oil nozzle sleeve, and openings of the first oil nozzles and the second oil nozzles are respectively gradually increased and gradually decreased along a clockwise direction, the first oil nozzles and the second oil nozzles are respectively located on two circular lines, and the distance between the two circular lines is equal to an axial movement distance of the sliding sleeve; the cam mechanism includes: first cam slots and second cam slots which are continuously formed on the oil nozzle sleeve along the circumference of the oil nozzle sleeve, where projections of the first cam slots and the second cam slots on a cross section of the oil nozzle sleeve are in shapes of annular sectors, widths at ends, away from the second cam slots, of the first cam slots are gradually decreased to form first internal corner ends, widths at ends, away from the first cam slots, of the second cam slots are gradually decreased to form second internal corner ends, first external corner ends toward centers of the second cam slots are formed between adjacent first cam slots of the first cam slots, and second external corner ends toward centers of the first cam slots are formed between adjacent second cam slots of the second cam slots; and a cam follower fixedly connected to the sliding sleeve and slidably connected to the first cam slots or the second cam slots, where the cam follower rotates around the circumference of the oil nozzle sleeve in processes of moving from the first internal corner ends to the second internal corner ends or moving from the second internal corners end to the first internal corner ends.

Further, the projections of the first cam slots and the second cam slots on a longitudinal section of the oil nozzle sleeve are in shapes of right triangles.

Further, the ends, away from the second cam slots, of the first cam slots and/or the ends, away from the first cam slots, of the second cam slots are connected with positioning slots, the positioning slots are sliding slots parallel to the axis of the oil nozzle sleeve, and the positioning slots are in clearance fit with the cam follower.

Further, the cam follower is a pin.

Further, the outer layer structure further includes an upper outer cylinder and a lower outer cylinder respectively connected to two ends of the sand control screen; and the inner layer structure further includes an upper inner cylinder and a lower inner cylinder respectively connected to two ends of the oil nozzle sleeve.

Further, the middle layer structure further includes an upper piston and a lower piston respectively connected to two ends of the sliding sleeve, where the upper piston is slidably arranged in an upper hydraulic chamber formed between the upper outer cylinder and the upper inner cylinder, and the lower piston is slidably arranged in a lower hydraulic chamber formed between the lower outer cylinder and the lower inner cylinder.

Further, the driver further includes: an upper joint connected to the upper hydraulic chamber and located at an end, away from the sliding sleeve, of the upper hydraulic chamber; a lower joint connected to the lower hydraulic chamber and located at an end, away from the sliding sleeve, of the lower hydraulic chamber; and a hydraulic system connected to the upper joint and the lower joint and configured for inputting and extracting hydraulic oil to/from the upper hydraulic chamber and the lower hydraulic chamber respectively.

Further, the screen holes are formed in the sand control screen.

Compared with the prior art, the present disclosure has the following beneficial effects.

A downhole inflow control valve with multi-stage regulation is provided. In the process that the driver drives the sliding sleeve to perform a straight reciprocating motion every time, the cam mechanism drives the sliding sleeve to rotate at a certain angle relative to the oil nozzle sleeve, so that the oil inlet holes in the sliding sleeve sequentially align to the oil inlet nozzle groups with different openings on the oil nozzle sleeve to control the inflow rate.

BRIEF DESCRIPTION OF THE DRAWINGS

In order to more clearly illustrate the technical solutions in the embodiments of the present disclosure or in the prior art, the drawings, which need to be used in the description or the prior art description, are briefly described below. Apparently, the attached figures in the following description are merely exemplary. For those skilled in the art, other implementation attached figures further can be obtained according to these attached figures without creative labor.

Reference signs in the attached figures:

11 upper joint; 12 upper outer cylinder; 13 sand control screen; 14 lower outer cylinder; 15 lower joint; 21 upper piston; 22 sliding sleeve; 23 lower piston; 24 oil inlet hole; 31 upper inner cylinder; 32 oil nozzle sleeve; 33 lower inner cylinder; 34 oil inlet nozzle group; 35 first oil nozzle; 36 second oil nozzle; 41 first cam slot; 42 first internal corner end; 43 first external corner end; 44 second cam slot; 45 second internal corner end; 46 second external corner end; 47 cam follower; and 48 positioning slot.

DETAILED DESCRIPTION OF THE EMBODIMENTS

The following clearly and completely describes the technical solution in the embodiments of the present disclosure with reference to the attached figures of the embodiments of the present disclosure. Apparently, the described embodiments are merely a part rather than all of the embodiments of the present disclosure. Based on the embodiments in the present disclosure, all other embodiments acquired by those skilled in the art under the premise of without creative labor fall within the scope protected by the present disclosure.

Embodiment I

Figure 1:
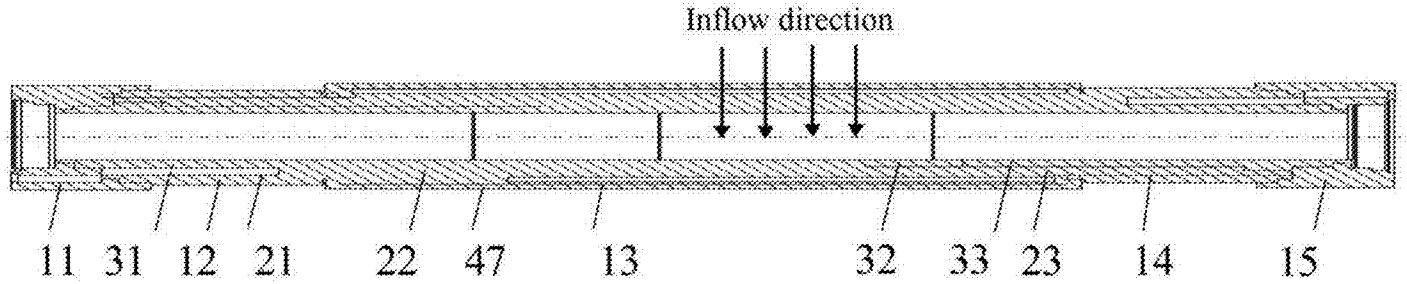
FIG. 1 is a section view of a longitudinal section according to an embodiment of the present disclosure.

A downhole inflow control valve with multi-stage regulation is provided below. FIG. 1 illustrates a section view of a longitudinal section of the inflow control valve, combined with FIG. 1.

The downhole inflow control valve includes:

an outer layer structure including an upper joint 11, an upper outer cylinder 12, a sand control screen 13, a lower outer cylinder 14 and a lower joint 15 which are sequentially connected;

a middle layer structure including an upper piston 21, a sliding sleeve 22 and a lower piston 23 which are sequentially connected; and an inner layer structure including an upper inner cylinder 31, an oil nozzle sleeve 32 and a lower inner cylinder 33 which are sequentially connected;

wherein the sliding sleeve 22 is located between the sand control screen 13 and the oil nozzle sleeve 32, screen holes are formed in the sand control screen 13, one of the oil nozzle sleeve 32 and the sliding sleeve 22 is provided with oil inlet nozzle groups 34 uniformly arranged around its own axis, the other of the oil nozzle sleeve 32 and the sliding sleeve 22 is provided with oil inlet holes 24 capable of interfacing with any oil inlet nozzle group 34, and oil on an outer side of the sand control screen 13 enters into an inner side of the oil nozzle sleeve 32 through the screen holes, the oil inlet nozzle groups 34 and the oil inlet holes 24 to realize inflow;

the upper piston 21 is located in an upper hydraulic chamber formed between the upper outer cylinder 12 and the upper inner cylinder 31, and the upper joint 11 is configured for inputting hydraulic oil between the upper outer cylinder 12 and the upper inner cylinder 31 so that the upper piston 21 pushes the sliding sleeve 22 to move toward the lower joint 15;

the lower piston 23 is located in a lower hydraulic chamber formed between the lower outer cylinder 14 and the lower inner cylinder 33, and the lower joint 15 is configured for inputting hydraulic oil between the lower outer cylinder 14 and the lower inner cylinder 33 so that the lower piston 23 pushes the sliding sleeve 22 to move toward the upper joint 11; and the sliding sleeve 22 and the oil nozzle sleeve 32 are connected through a cam mechanism, one of the sliding sleeve 22 and the oil nozzle sleeve 32 is fixed, the other of the sliding sleeve 22 and the oil nozzle sleeve 32 may rotate around own axis, the inflow rates of the oil inlet nozzle groups 34 are different, the cam mechanism is configured for converting the linear motion of the sliding sleeve 22 into the rotary motion of the sliding sleeve 22 or the oil nozzle sleeve 32 to promote the oil inlet holes 24 to interface with different oil inlet nozzle groups 34 so as to control the inflow rate.

A hydraulic system is connected to the upper joint 11 and the lower joint 15 and configured for inputting and extracting hydraulic oil to/from the upper hydraulic chamber and the lower hydraulic chamber respectively. The upper hydraulic chamber and the upper piston 21 are combined into a hydraulic cylinder capable of outputting thrust uniaxially only. The reset of the upper piston 21 is realized by reverse thrust provided by another hydraulic cylinder formed by the combination of the lower hydraulic cylinder and the lower piston 23.

The movement direction of the sliding sleeve 22 may be controlled by switching the direction of the hydraulic oil flowing into and out of the upper hydraulic chamber and the lower hydraulic chamber. The sliding sleeve 22 may perform linear reciprocating motion by repeatedly switching the direction of the hydraulic oil flowing into and out of the upper hydraulic chamber and the lower hydraulic chamber.

Figure 2A:
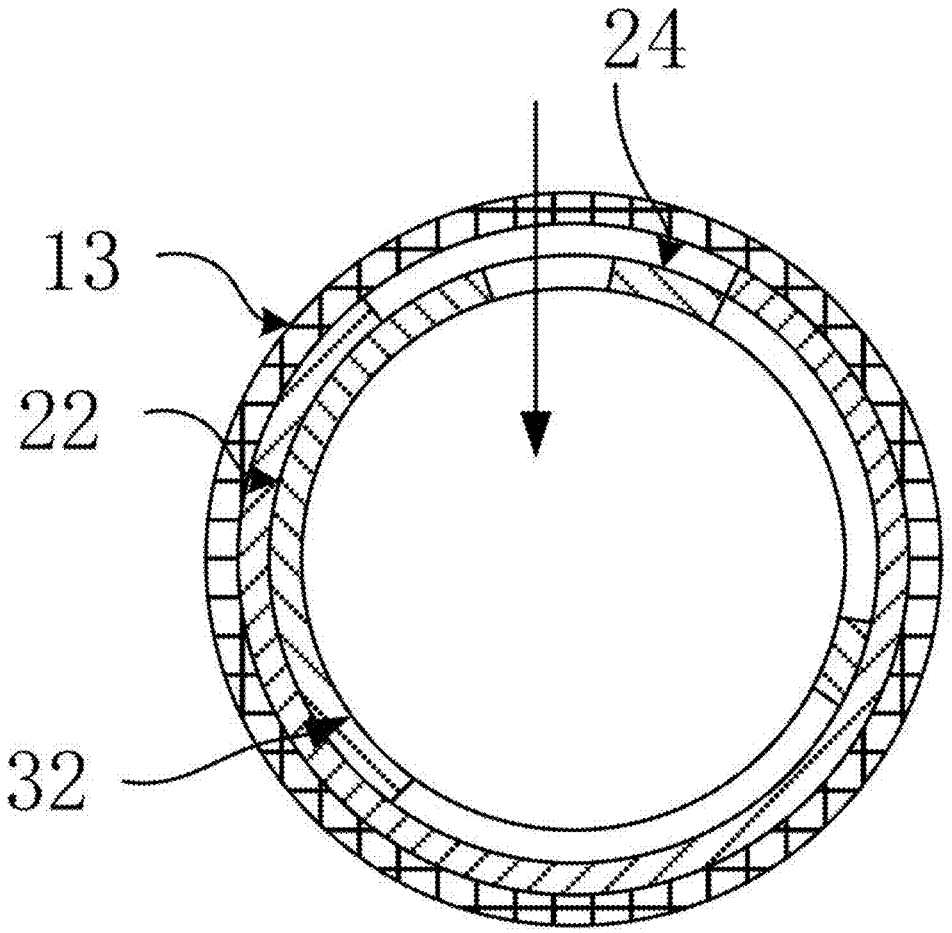
FIGS. 2A-2C are section views of a cross section according to an embodiment of the present disclosure.
Figure 2B:
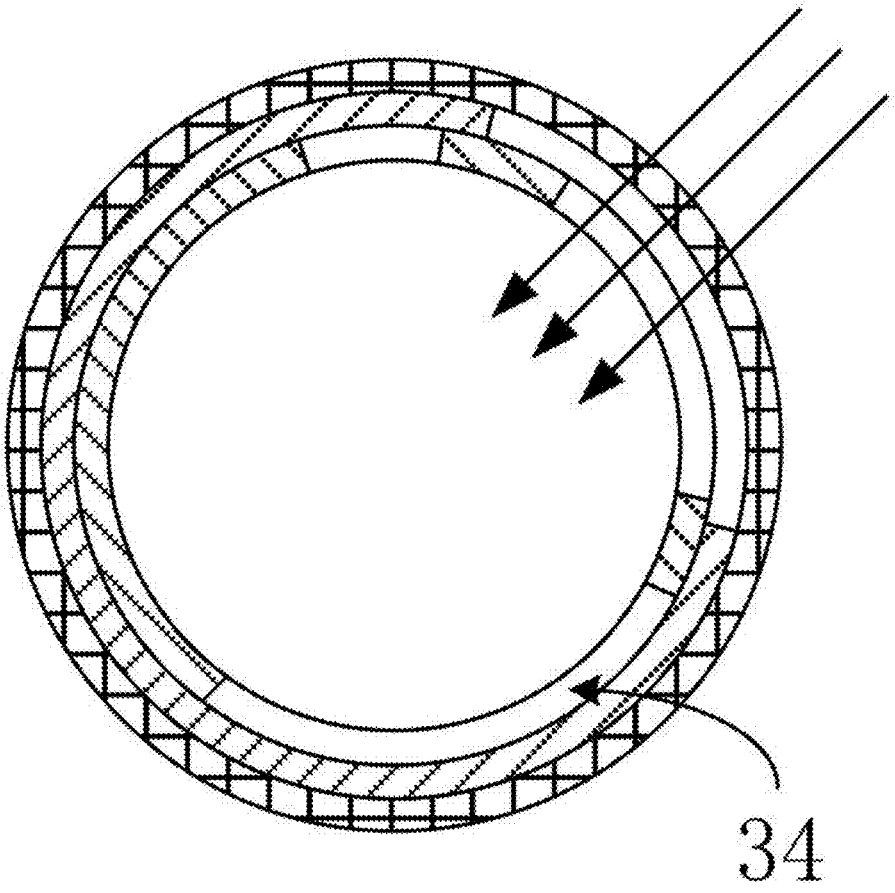
Figure 2C:
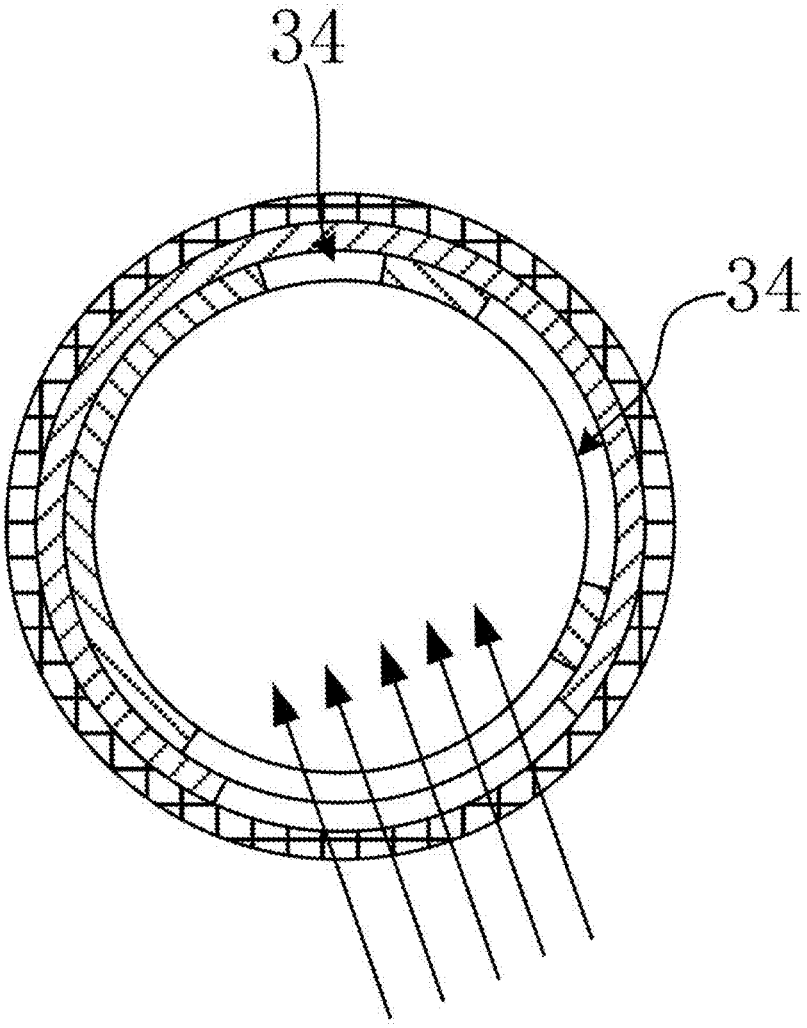

FIGS. 2A-2C illustrate section views of the cross section of the inflow control valve, the sectioning part includes a sand control screen 13, an oil nozzle sleeve 32 and a sliding sleeve 22, combined with FIGS. 2A-2C.

The oil inlet nozzle group 34 includes first oil nozzles 35 with different sizes arranged on the oil nozzle sleeve 32. The oil inlet holes 24 are formed in the sliding sleeve 22. The cam mechanism rotates the sliding sleeve 22 by a certain angle every time when the sliding sleeve 22 is pushed by the upper piston 21 and the lower piston 23 to perform a straight reciprocating motion. In the sequence of FIG. 2A, FIG. 2B and FIG. 2C, the oil inlet holes 24 align to the oil inlet nozzle groups 34 with gradually increased openings in sequence, so that the inflow rate is gradually increased.

Figure 3:
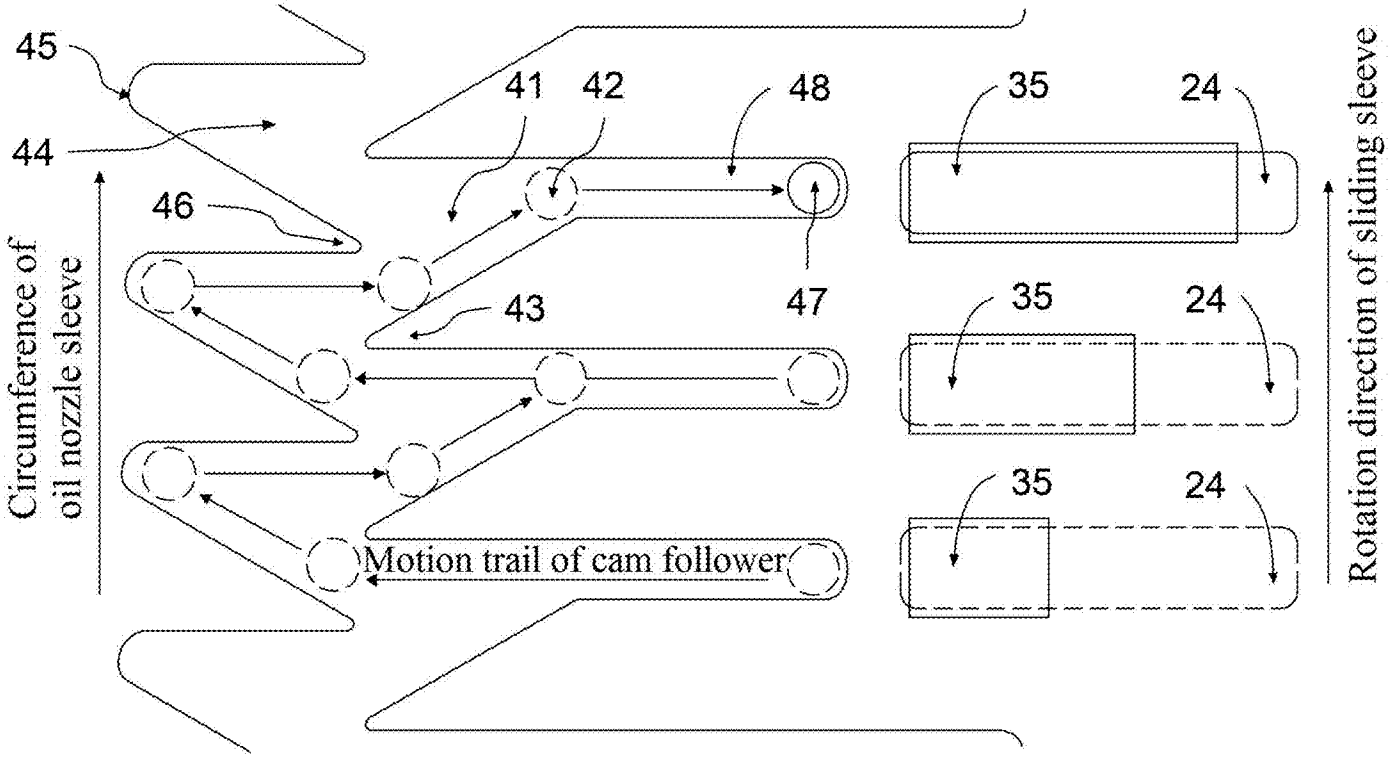
FIG. 3 is a structure diagram of a cam mechanism according to a first embodiment of the present disclosure.

FIG. 3 illustrates a structure diagram of a cam mechanism suitable for connecting with the oil nozzle sleeve 32 and the sliding sleeve 22. The oil nozzle sleeve 32 and the sliding sleeve 22 are not illustrated in the figure, combined with FIG. 3.

The cam mechanism includes:

first cam slots 41 and second cam slots 44 which are continuously formed on the oil nozzle sleeve 32 along the circumference of the oil nozzle sleeve 32, where projections of the first cam slots 41 and the second cam slots 44 on a cross section of the oil nozzle sleeve 32 are in shapes of annular sectors, widths at ends, away from the second cam slots 44, of the first cam slots 41 are gradually decreased to form first internal corner ends 42, widths at ends, away from the first cam slots 41, of the second cam slots 44 are gradually decreased to form second internal corner ends 45, first external corner ends 43 toward centers of the second cam slots 44 are formed between the adjacent first cam slots 41, and second external corner ends 46 toward centers of the first cam slots 41 are formed between the adjacent second cam slots 44; and a cam follower 47 fixedly connected to the sliding sleeve 22 and slidably connected to the first cam slots 41 or the second cam slots 44, where the cam follower 47 rotates around the circumference of the oil nozzle sleeve 32 in processes of moving from the first internal corner end 42 to the second internal corner end 45 or moving from the second internal corner 45 to the first internal corner end 42.

The oil inlet nozzle group 34 includes first oil nozzles 35 equally spaced around the circumference of the oil nozzle sleeve 32, and the openings of the first oil nozzles 35 are gradually increased or gradually decreased along the clockwise direction.

The working principle of the cam mechanism is as follows.

The first cam slot 41 and the second cam slot 44 are sliding slots formed in the inner wall of the oil nozzle sleeve 32, and may be directly connected or connected through an annular groove around the axis of the oil nozzle sleeve 32. The sliding sleeve 22 and the cam follower 47 advance and retreat linearly along the axis of the nozzle sleeve 32 during the pushing process of the upper piston 21 and the lower piston 23. In the process that the cam follower 47 moves from the first cam slot 41 to the second cam slot 44 and then returns to the first cam slot 41, the sliding sleeve 22 complete one action of linear advancing and retreating and rotation to promote the oil inlet holes 24 to align to the different oil inlet nozzle groups 34.

Preferably, the projections of the first cam slot 41 and the second cam slot 44 on the longitudinal section of the oil nozzle sleeve 32 are in the shapes of right triangles. Due to the design, the widths of the first cam slot 41 and the second cam slot 44 are reduced, and more first cam slots 41 and second cam slots 44 are allowed to be arranged around the circumference of the oil nozzle sleeve 32.

Preferably, an end, away from the second cam slot 44, of the first cam slot 41 or an end, away from the first cam slot 41, of the second cam slot 44 is connected with a positioning slot 48. The positioning slot 48 is a sliding slot parallel to the axis of the oil nozzle sleeve 32. The positioning slot 48 is in clearance fit with the cam follower 47. Due to the design of the positioning slot 48, automatic rotation is unlikely to occur when linear advancing and retreating actions are not performed to avoid the oil inlet holes 24 and the oil inlet nozzle groups 34 from being staggered from each other.

Embodiment II

The defect of embodiment I is that the sliding sleeve 22 has to rotate by one circle and then returns to the original position. That is, if the linear advancing and retreating motion of the sliding sleeve 22 is converted into the clockwise rotation of the sliding sleeve 22 by the cam mechanism, and the openings of the oil inlet nozzle groups 34 are gradually increased along the clockwise direction, the inflow rate is reduced after the sliding sleeve 22 has to rotate in the clockwise direction by nearly one circle.

In order to solve this problem, embodiment II provides a cam mechanism different from that of embodiment I, so that the inflow rate may be reduced and the inflow rate may be increased when the sliding sleeve 22 rotates in the clockwise direction.

Figure 4:
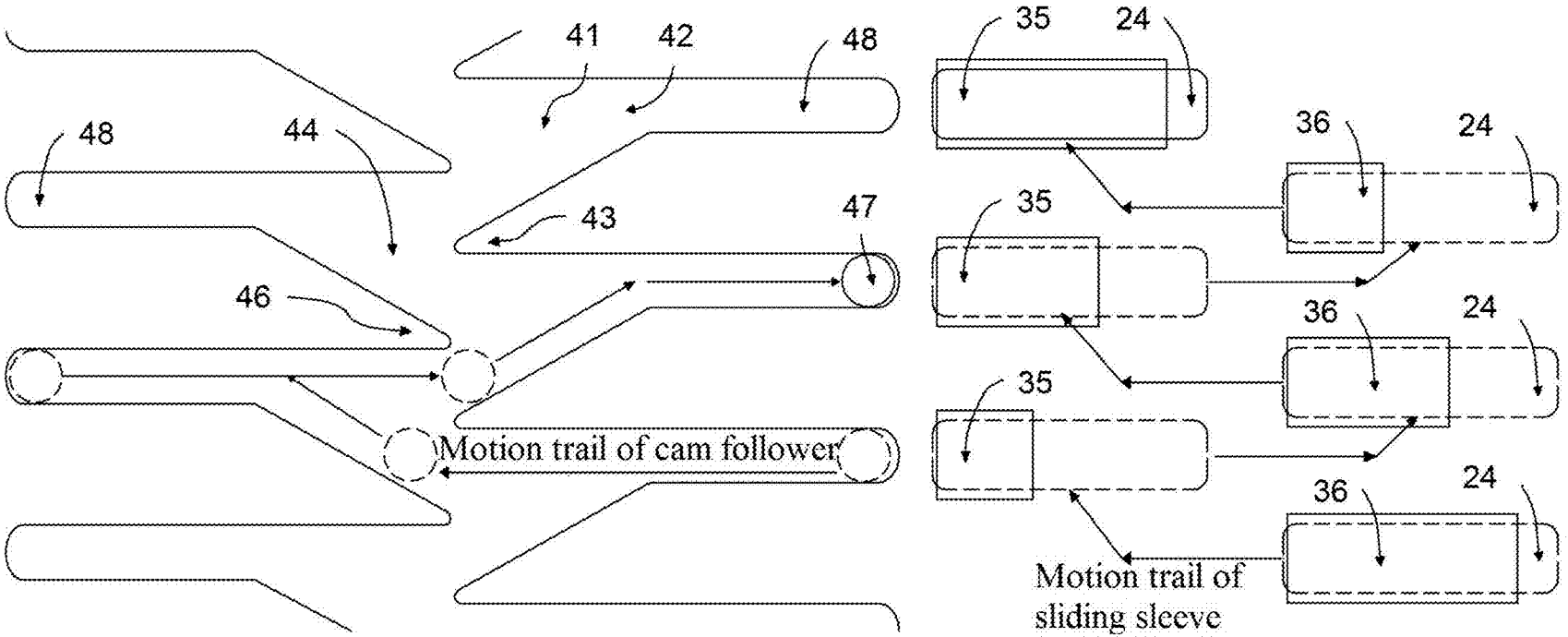
FIG. 4 is a structure diagram of a cam mechanism according to a second embodiment of the present disclosure.

FIG. 4 illustrates a cam mechanism in embodiment II, combined with FIG. 4.

The cam mechanism includes:

first cam slots 41 and second cam slots 44 which are continuously formed on the oil nozzle sleeve 32 along the circumference of the oil nozzle sleeve 32, where the projections of the first cam slots 41 and the second cam slots 44 on a cross section of the oil nozzle sleeve 32 are in shapes of annular sectors, widths at ends, away from the second cam slots 44, of the first cam slots 41 are gradually decreased to form first internal corner ends 42, widths at ends, away from the first cam slots 41, of the second cam slots 44 are gradually decreased to form second internal corner ends 45, first external corner ends 43 toward centers of the second cam slots 44 are formed between the adjacent first cam slots 41, and second external corner ends 46 toward centers of the first cam slots 41 are formed between the adjacent second cam slots 44; and a cam follower 47 fixedly connected to the sliding sleeve 22 and slidably connected to the first cam slots 41 or the second cam slots 44, where the cam follower 47 rotates around the circumference of the oil nozzle sleeve 32 in processes of moving from the first internal corner ends 42 to the second internal corner ends 45 or moving from the second internal corner ends 45 to the first internal corner ends 42.

An end, away from the second cam slot 44, of the first cam slot 41 and an end, away from the first cam slot 41, of the second cam slot 44 are connected with positioning slots 48.

The oil inlet nozzle group 34 includes first oil nozzles 35 and second oil nozzles 36 equally spaced around a circumference of the oil nozzle sleeve 32, and openings of the first oil nozzles 35 and second oil nozzles 36 are respectively gradually increased and gradually decreased along the clockwise direction, the first oil nozzles 35 and second oil nozzles 36 are respectively located on two circular lines, and the distance between the two circular lines is equal an axial movement distance of the sliding sleeve 22, that is, the distance between projections, on the axis of the oil nozzle sleeve 32, of the ends of the first positioning slot 48 and the second positioning slot 48 that are far away from each other.

In embodiment II, one rotational action performed by the own advancing and retracting of the sliding sleeve 22 is decomposed into two rotational actions respectively performed by advancing and retracting. Taking FIG. 4 as an example, when the cam follower 47 finally stays on the left side of FIG. 4 (that is, one end of the oil nozzle sleeve 32), the inflow rate may be increased by the own advancing and retracting of the sliding sleeve 22 every time. When the cam follower 47 finally stays on the right side of FIG. 4 (that is, the other end of the oil nozzle sleeve 32), the inflow rate may be decreased by the own advancing and retracting of the sliding sleeve 22 every time.

(Anything else that needs to be explained is as follows.)

The cam follower 47 is a pin.

The above embodiments are only exemplary embodiments of the present disclosure, and are not intended to limit the present disclosure. The scope of protection of the present disclosure is defined by the claims. Those skilled in the art can make various modifications or equivalent substitutions to the present disclosure within the essence and the scope of protection, and these modifications or equivalent substitutions should also be considered as embodiments of the present disclosure and fall within the scope of protection of the present disclosure.

What is claimed is:

1. A downhole inflow control valve with multi-stage regulation, comprising:

an outer layer structure comprising a sand control screen;

a middle layer structure comprising a sliding sleeve;

an inner layer structure comprising an oil nozzle sleeve; and a driver configured for driving the sliding sleeve to reciprocate along an axis of the sliding sleeve;

wherein the sliding sleeve is located between the sand control screen and the oil nozzle sleeve, screen holes are formed in the sand control screen, oil inlet nozzle groups are uniformly arranged on one of the oil nozzle sleeve and the sliding sleeve around an axis of the oil nozzle sleeve or the axis of the sliding sleeve, oil inlet holes capable of interfacing with any one of the oil inlet nozzle groups are formed on an other of the oil nozzle sleeve and the sliding sleeve, and oil on an outer side of the sand control screen enters into an inner side of the oil nozzle sleeve through the screen holes, the oil inlet nozzle groups and the oil inlet holes to realize inflow;

the sliding sleeve and the oil nozzle sleeve are connected through a cam mechanism, one of the sliding sleeve and the oil nozzle sleeve is fixed, an other of the sliding sleeve and the oil nozzle sleeve is capable of rotating around the axis of the other of the sliding sleeve and the oil nozzle sleeve, inflow rates of the oil inlet nozzle groups are different, the cam mechanism is configured for converting a linear motion of the sliding sleeve into a rotary motion of the sliding sleeve or the oil nozzle sleeve to promote the oil inlet holes to interface with different oil inlet nozzle groups so as to control the inflow rates;

each of the oil inlet nozzle groups comprises first oil nozzles and second oil nozzles equally spaced around a circumference of the oil nozzle sleeve, and sizes of openings of the first oil nozzles and the second oil nozzles are respectively gradually increased and gradually decreased along a same circumferential direction, the first oil nozzles and the second oil nozzles are respectively located on two circular lines, and the distance between the two circular lines is equal to an axial movement distance of the sliding sleeve;

the cam mechanism comprises:

first cam slots and second cam slots which are continuously formed on the oil nozzle sleeve along the circumference of the oil nozzle sleeve, wherein projections of the first cam slots and the second cam slots on a cross section of the oil nozzle sleeve are in shapes of annular sectors, widths at ends, away from the second cam slots, of the first cam slots are gradually decreased to form first internal corner ends, widths at ends, away from the first cam slots, of the second cam slots are gradually decreased to form second internal corner ends, first external corner ends toward centers of the second cam slots are formed between adjacent first cam slots of the first cam slots, and second external corner ends toward centers of the first cam slots are formed between adjacent second cam slots of the second cam slots; and a cam follower fixedly connected to the sliding sleeve and slidably connected to the first cam slots or the second cam slots, wherein the cam follower rotates around the circumference of the oil nozzle sleeve in processes of moving from the first internal corner ends to the second internal corner ends or moving from the second internal corner ends to the first internal corner ends.

2. The downhole inflow control valve with multi-stage regulation according to claim 1, wherein the outer layer structure further comprises an upper outer cylinder and a lower outer cylinder respectively connected to two ends of the sand control screen; and the inner layer structure further comprises an upper inner cylinder and a lower inner cylinder respectively connected to two ends of the oil nozzle sleeve.

3. The downhole inflow control valve with multi-stage regulation according to claim 1, wherein the ends, away from the second cam slots, of the first cam slots and/or the ends, away from the first cam slots, of the second cam slots are connected with positioning slots, the positioning slots are sliding slots parallel to the axis of the oil nozzle sleeve, and the positioning slots are in clearance fit with the cam follower.

4. The downhole inflow control valve with multi-stage regulation according to claim 3, wherein the cam follower is a pin.

* * * * *